US006672804B1

(12) United States Patent
Hallot et al.

(10) Patent No.: US 6,672,804 B1
(45) Date of Patent: Jan. 6, 2004

(54) DEVICE AND METHOD FOR MAINTAINING AND GUIDING A RISER, AND METHOD FOR TRANSFERRING A RISER ONTO A FLOATING SUPPORT

(75) Inventors: Raymond Hallot, La Ciotat (FR); Michel Baylot, Marseilles (FR); Xavier Rocher, Chatou (FR)

(73) Assignee: Bouygues Offshore, Montigny le Bretonneux (FR)

( * ) Notice: Subject to any disclaimer, the term of this patent is extended or adjusted under 35 U.S.C. 154(b) by 0 days.

(21) Appl. No.: 10/049,012

(22) PCT Filed: Aug. 3, 2000

(86) PCT No.: PCT/FR00/02244

§ 371 (c)(1),
(2), (4) Date: Mar. 5, 2002

(87) PCT Pub. No.: WO01/11184

PCT Pub. Date: Feb. 15, 2001

(30) Foreign Application Priority Data

Aug. 9, 1999 (FR) ..... 99 10417

(51) Int. Cl.[7] ..... E21B 17/10

(52) U.S. Cl. ..... 405/224.4; 114/264; 405/224.3; 166/355

(58) Field of Search ..... 114/264; 405/211, 405/224.3, 224.4; 166/367, 350, 345, 355, 356

(56) References Cited

U.S. PATENT DOCUMENTS

| | | | | |
|---|---|---|---|---|
| 3,496,898 A | | 2/1970 | Morgan | 114/294 |
| 3,605,415 A | | 9/1971 | Mohlman | 114/264 |
| 4,136,633 A | * | 1/1979 | Homer et al. | 114/264 |
| 4,231,429 A | | 11/1980 | Kolpak | 166/367 |
| 4,466,488 A | * | 8/1984 | Nayler et al. | 166/355 |
| 4,505,614 A | | 3/1985 | Anschutz | 405/195.1 |
| 4,616,707 A | * | 10/1986 | Langner | 166/345 |
| 4,616,708 A | | 10/1986 | da Mota | 166/355 |
| 4,617,998 A | | 10/1986 | Langner | 166/345 X |
| 4,818,147 A | * | 4/1989 | Rasmussen | 405/224 |
| 4,913,238 A | | 4/1990 | Danazcko | 166/350 X |
| 5,551,803 A | | 9/1996 | Pallini, Jr. et al. | 405/223.1 |
| 5,971,075 A | | 10/1999 | Odru et al. | 166/350 |

FOREIGN PATENT DOCUMENTS

| | | | |
|---|---|---|---|
| GB | 2 146 684 | 4/1985 | E21B/17/01 |
| GB | 2 188 899 | 10/1987 | B66D/1/54 |
| GB | 2 302 555 | 1/1997 | E21B/17/01 |
| WO | WO 90/07049 | 6/1990 | E21B/19/00 |

* cited by examiner

*Primary Examiner*—Thomas B. Will
*Assistant Examiner*—Tara L. Mayo
(74) *Attorney, Agent, or Firm*—Cohen, Pontani, Lieberman & Pavane

(57) ABSTRACT

An apparatus for holding and guiding a floating riser relative to a floating support. The apparatus includes a guidance mechanism secured to the floating support for enabling the riser to rotate about a horizontal axis perpendicular to a longitudinal axis of the riser; and for enabling the riser to slide longitudinally along the longitudinal axis and lateral displacement of the riser to be guided in a horizontal plane perpendicular to the longitudinal axis of the riser. The guidance mechanism includes friction pads mounted on a pad support for enabling the pads to pivot. The pads preferably cooperate with wheels such that the wheels bear against the riser and enable it to slide, and the riser comes to bear against the pads only when the wheels are moved away under the effect of lateral displacements of the riser.

33 Claims, 11 Drawing Sheets

Z-Z'

21
1
23
15
3
20
16
P'1
17a
17a
3
22-1
4
P 0
22-2
3
P'2
9
17b
5
17b
33

DEVICE AND METHOD FOR MAINTAINING AND GUIDING A RISER, AND METHOD FOR TRANSFERRING A RISER ONTO A FLOATING SUPPORT

PRIORITY CLAIM

This is a U.S. national stage of application No. PCT/FR00/02244, filed on Aug. 3, 2000 which claims priority from French Patent Application No. 9910417 filed on Aug. 9, 1999.

FIELD OF THE INVENTION

The present invention relates in general to the field of bottom-to-surface type connections of the type including a vertical underwater pipe referred to as an up column or riser, connecting the sea bed to a floating support installed on the surface.

BACKGROUND OF THE INVENTION

Once the depth of water becomes large, production fields and in particular oil fields are generally operated from floating supports. In general, the floating support has anchor means to keep it in position in spite of the effects of currents, winds, and swell. It generally also includes oil storage and processing means together with means for off-loading to off-loading tankers. Such tankers arrive at regular intervals to off-load production. Such floating supports, which are generally of the barge type, are commonly referred to by the initials "FPSO" for floating production storage off-loading. Numerous variants have been developed such as SPARs (which are long vertical floating cigar-shaped objects held in position by catenary anchoring) or indeed TLPs (tension leg platforms) which are platforms whose "legs" are anchor lines under tension, which lines generally extend vertically.

Wellheads are often distributed over an entire field and production pipes, together with water injection lines and inspection and control cables, are all placed on the sea bed to extend towards a fixed location vertically below the position of the floating support on the surface.

Some wells are thus situated vertically beneath the floating support and the insides of such wells can then be accessed directly from the surface. Under such circumstances, a wellhead fitted with its "Christmas tree" can be installed on the surface on board the floating support. It is then possible to use a derrick installed on said floating support to perform all of the drilling, production, and maintenance operations required on the well throughout its lifetime. This is referred to as a "dry" wellhead.

With SPARs and TLPs, dry wellheads are brought together in a limited zone of the platform over which the derrick is displaceable to take up a position vertically over each of the wells so as to perform drilling operations or maintenance operations on a well throughout the lifetime of the field.

Since a drilling derrick is a tall structure, possibly 60 meters (m) tall and possessing a hoisting capacity that can exceed 500 tonnes (t), the means required for moving it from one well to another and for keeping it in position during operations on any particular well give rise to structures that are complex and expensive.

In order to maintain the riser fitted with its dry wellhead in a substantially vertical position, it is appropriate to exert upward traction which can be applied either by a cable tensioning system using winches or hydraulic actuators installed on the floating support, or else by means of floats distributed along the riser and installed at various depths, or indeed by a combination of those two techniques.

French patent FR 2 754 011 describes a barge and a guidance system for a riser, in which the riser is fitted with floats.

SPARs and TLPs are likewise fitted with a multiplicity of risers supported by floats that are held in position by guidance systems.

In FPSOS, risers reach the surface in a central cavity of the floating support that is referred to as a "wellbay". The cavity passes right through the hull vertically over a height of about 30 meters, drawing water to a depth of about 20 meters. It is generally installed on the axis of the floating support, at equal distances from its ends since this is the zone in which the amplitudes of movements and of accelerations are the smallest when the vessel is subjected to the phenomena of roll, pitch, and yaw.

The depth of water over some oil fields exceeds 1500 m, and can be as much as 2000 m to 3000 m, so the weight of risers for such depths requires vertical forces to be deployed to keep them in position that can be as great as or more than several hundreds of tonnes. Buoyancy elements of the "can" type are used which are installed at various levels along risers connecting the surface to ultragreat depths (1000 m–3000 m).

The floats concerned are of large dimensions and in particular they have a diameter in excess of 5 m, and a length of 10 m to 20 m, with each float delivering buoyancy that can be as much as 100 tonnes.

The float and the riser are subjected to the effects of swell, and of current, but since they are connected to the FPSO on the surface, they are also indirectly subjected to the effects of wind. This gives rise to lateral and vertical movements of the assembly comprising the riser, the floats, and the barge, which movements can be large, as much as several meters, particularly in a zone that is subject to swell.

To ensure that risers do not interfere with one another and do not interfere with the hull of the floating support, said risers are spaced apart from one another by several meters and also by several meters from the walls of the wellbay, which means that such wellbays can often be as much as 80 m long and 20 m wide on FPSO barges that are themselves as much as 350 m and 80 m wide, and rising by as much as 35 m above the water line. Such barges have a deadweight that can be as much as or greater than 500,000 tonnes deadweight.

These riser movements give rise to large differential forces between a riser and the guidance systems secured to the floating support.

The amplitude of the displacements and the very high level of the forces in the risers make it necessary to design guidance systems capable of withstanding not only extreme conditions, but also phenomena of fatigue and wear of the kind that can accumulate over the lifetime of such an installation, which can exceed 25 years.

The present invention relates to guiding risers within the generally central cavity when in a production position or when in a position in which drilling operations and heavy maintenance operations can be performed on the well, i.e. using a derrick which is fixed relative to the floating support, or indeed on the means for transferring the riser between these various positions.

The present invention also relates to transferring risers within the generally central cavity between their production positions and a position in which drilling operations and heavy maintenance operations can be performed on the well, i.e. using a derrick which is fixed relative to the floating support.

Well drilling is thus performed on the main axis of the derrick through a "drilling" riser whose function is to guide the drill strings and to contain the mud returned from a well that is being drilled. Such a drilling riser is made up from unit lengths that can be as much as 50 m long, with the entire assembly being lowered step by step as the said riser is assembled. At the end of drilling, the portion of the riser corresponding to the depth of water is disconnected from the well at the sea bed, and is then taken to a parking position after its length has been shortened by removing one or two of the unit lengths. By proceeding in this way, the drilling riser remains suspended with its bottom end situated at 50 m to 100 m from the sea bed.

The production riser can then be assembled step by step in the same manner until it reaches the entrance to the well. Floats are installed on the top portion as it is put into place, and finally the bottom of the production riser is connected to the well. The well is then fitted with various items of production tubing and the "Christmas tree" of the dry wellhead is put into place.

The assembly is then transferred to its "slot", i.e. its production position in which it will remain throughout the lifetime of the field, except when certain maintenance operations are performed that require said riser to be returned to the main axis of the derrick in order to perform heavy maintenance operations.

Means are known for guiding a riser relative to a floating support. However, those guide systems usually imply cable-tensioning systems which are difficult to implement (GB 2 170 240 or U.S. Pat. No. 4,231,429). Other systems have been proposed that are not general purpose but are specific to the riser being located in one position relative to the floating support, and in particular on the axis of the derrick.

Cable-tensioning guidance systems make it lengthy and difficult to transfer a riser from one position to another within the central cavity or wellbay, particularly when displacing a riser from its production position to being in position on the axis of the derrick.

SUMMARY OF THE INVENTION

An object of the present invention is to provide apparatus for holding and guiding a riser, in particular a floating riser, relative to the floating support, which apparatus is simple to implement and can be used whatever the position of the riser, in particular when the riser is in its production position or in its drilling position or maintenance position on the axis of the derrick; and even while the riser is being transferred from its production position to the axis of the derrick.

The apparatus must allow relative movement to take place between the floating support and the riser so as to withstand common loading forces corresponding to lateral loads that can be as great as 10 tonnes, and occasional extreme forces corresponding to loads that can be as great at 100 tonnes or even 200 tonnes.

The device must not only allow substantially vertical displacements of up to 5 meters for relative movements between the floating support and the risers in normal operation, but it must also accept extreme displacements corresponding to the floating support being fully deballasted or to being fully ballasted, which corresponds to a total stroke that can be as much as 15 meters to 20 meters. In addition, for operations performed on the axis of the derrick, the riser must remain substantially in line with the axis of the derrick.

Another object of the present invention is to provide guidance apparatus enabling the riser to be transferred from one position to another within the central cavity or wellbay in a manner that is simple to perform and can therefore be performed in complete safety.

To do this, the present invention provides apparatus for holding and guiding a riser, in particular a floating riser, relative to a floating support, the apparatus having guide means enabling said riser to slide along its longitudinal axis and guiding lateral displacements thereof in a horizontal plane perpendicular to said longitudinal axis of the riser. The apparatus of the invention comprises joint means secured to said floating support and enabling:

a) said riser to rotate about a horizontal axis perpendicular to the longitudinal axis of said riser within a cone of half-angle at the apex that is less than or equal to 10°, said horizontal axis and said apex of the cone being situated substantially at the center of the riser and level with the midplane of the zone in which said joint means are situated along the longitudinal axis; and b) said riser to slide along its longitudinal axis and for the lateral displacements of said riser to be guided in a plane substantially perpendicular to said longitudinal axis of the riser; and said joint means comprising:

first friction pads mounted on a pad support enabling said pads to pivot about an axis perpendicular to said longitudinal axis of said riser; and said first pads co-operating with second friction pads, or preferably with wheels, so that said second pads or said wheels bear against said riser and enable it to slide, and said riser bears against said first pads only when said wheels are displaced under the effect of lateral displacements of said riser. It will be understood that the lateral displacements of the riser are generated by relative forces between the floating support and the riser.

The term "longitudinal axis of the riser" is used to mean the vertical axis when the riser is in its rest position, i.e. when it is not subject to movement associated with movements of the sea.

The apparatus of the invention is designed to support varying amounts of force in the horizontal plane. Said second pads or the wheels preferably serve to guide the riser when subjected to everyday forces at low loadings of up to about 10 tonnes and the first pads provide guidance when the riser is subjected to heavy loadings under extreme conditions, in particular loadings up to 100 tonnes or even 200 tonnes.

Said first pads have respective bearing surfaces on said riser which are preferably curved in a manner that is complementary to the curve of the riser.

In an embodiment, said first pads can pivot about respective axes secured to said pad support.

In another embodiment, said pads are fixed relative to said pad support and said pad support can pivot relative to said floating support to enable said pivoting of said first pads about an axis perpendicular to said longitudinal axis of said riser.

More particularly, said first pads are fixed on a tubular element encasing said riser coaxially, said tubular element being mounted on a ball and socket joint enabling said pivoting and said rotation respectively of said pads and of said riser.

In the apparatus of the invention, said ball and socket joint can be a laminated abutment with said tubular element being embedded therein.

Advantageously, said second pads or preferably said wheels are mounted on axes perpendicular to the vertical axis of said riser, the axes of said second pads or preferably said wheels being capable of moving in translation along axes that are perpendicular to the longitudinal axis of said riser.

Said first pads are preferably distributed symmetrically around said riser and comprise at least three pads, preferably all situated at the same level along the longitudinal axis of said riser.

Said second pads or preferably said wheels are preferably disposed symmetrically around said riser about its longitudinal axis and with at least three wheels having axes of rotation that are preferably situated substantially in a single plane.

In an embodiment, said first pads are mounted on an axis that is situated substantially in the same horizontal plane as the axes of said wheels and said first pads, and said wheels are disposed successively and symmetrically around said riser in alternating manner.

In another embodiment, said first pads and said wheels are disposed in a staggered configuration, with their respective pivot axes and rotation axes being situated at different respective levels along the longitudinal axis of said riser.

More particularly, said first pads are disposed on at least two different levels along said longitudinal axis of said riser, and said levels are disposed symmetrically about a horizontal plane corresponding substantially to the midplane of the zone in which said joint means are situated along the longitudinal axis.

In another variant embodiment, the axes of rotation of the wheels are disposed on at least two different planes perpendicular to said longitudinal axis of said riser, and said planes are disposed symmetrically about a horizontal plane corresponding substantially to said midplane of the zone along the longitudinal axis of said riser where said joint means are situated.

In another variant embodiment, said first pads can be situated on two different levels along the longitudinal axis of said riser, an upper level and a lower level, and said wheels are situated above said upper level and below said lower level.

In another variant, said first pads are situated on two different levels, an upper level and a lower level, and said wheels are situated between said levels.

The holding and guidance apparatus of the invention can be installed on the floating support to hold and guide one of said risers in its production position, or it can be connected to transfer means for transferring one of said risers from its production position to the axis of a drilling derrick, in both cases, said joint means are preferably disposed level with the junction floor between said riser and said support, situated between the deck of the floating support and water level.

Also preferably, the apex of the cone whose halfangle at the apex is less than 10° is situated substantially at the level of said junction floor.

Holding and guidance apparatus of the invention can also be installed on said floating support to hold and guide one of said risers in its operating position in a derrick installed on said floating support, and more precisely on the axis of said derrick.

Holding and guidance apparatus of the invention can be located on the axis of the derrick at various levels along the longitudinal axis of the riser ZZ'. Depending on its position along the longitudinal axis, the dimensioning of the pads and the wheels needs to be adapted to match the forces that are to be transmitted and the relative movements of the riser that can be accommodated relative to the floating support.

It is possible to begin by putting the apparatus of the invention in place at the junction floor between the riser and the floating support, i.e. in a position that is intermediate between the deck of the floating support and water level. Under such circumstances, it is possible to use the same type of apparatus in the production position and while the riser is being transferred from its production position to the axis of the derrick. The wheels or the second pads are then dimensioned to support ordinary forces corresponding to loads that can reach 5 tonnes, and said first pads are dimensioned to support extreme forces corresponding to loads that can be as much as 50 tonnes.

It is also possible to position apparatus of the invention at at least one of two levels $P'_1$ and $P'_2$, preferably respectively above and below said junction floor between the riser and the floating support, the levels $P'_1$ and $P'_2$ being situated at different levels of the wall of the cavity in the floating support, and being sufficiently spaced apart to hold said riser substantially on the axis of the derrick, and to ensure that lateral displacements of the riser do not enable its axis to depart by more than 5° from the axis of the derrick, and preferably by no more than 2°.

The present invention thus provides apparatus including said joint means comprising said first pads cooperating preferably with wheels situated on a first level $P'_1$ and on a second level $P'_2$ along the wall of the central cavity of the floating support, respectively above and below the level $P_0$ of said junction floor between the riser and said floating support.

To limit ordinary forces and extreme forces transmitted to the planes $P'_1$ and $P'_2$ to loads respectively of 10 tonnes and of 100 tonnes, it is advantageous for the planes $P'_1$ and $P'_2$ to be spaced apart as much as possible, in particular by at least 5 meters, and preferably by at least 10 meters.

Insofar as the height of the wall of the cavity in the floating support is about 30 meters, given that it draws about 10 meters of water, and insofar as the plane $P'_1$ is situated above water level and slightly below the level of the deck of the floating support, it is possible for the lower plane $P'_2$ to be situated below water level.

In this position on the axis of the derrick, said joint means can be fixed inside a collar which is held in place around the riser by cables connected to a tensioning system to the wall of the cavity of said floating support, at least at one of said levels $P'_1$ and $P'_2$.

In another embodiment, said joint means comprising said first pads preferably co-operating with said wheels are situated at the end of a system of articulated arms including hydraulic actuators.

Advantageously, the system of articulated arms can move between a closed position and an open position such that in the closed position, said joint means preferably comprise said wheels which are in contact with said riser, and in the open position the system allows a float fitted to said floating riser to pass through, said joint means and preferably said wheels remaining in contact with said float.

Advantageously, each of the articulated arms in a given plane $P'_1$ or $P'_2$ can be adjusted in length, thereby making it possible to establish an offset of known value between the axis of the riser and the axis of the derrick.

The present invention also provides a method of holding and guiding a floating riser relative to a floating support, the method enabling said riser to slide along its longitudinal axis ZZ' and guiding its lateral displacements in a horizontal plane XX', YY' perpendicular to said riser by means of at least one holding and guidance apparatus of the invention.

The present invention also provides a method of transferring a riser on a floating support from a production position to a position within a drilling derrick. In the present invention, said riser is moved in said cavity of a floating support by displacing said holding and guidance apparatus of the riser relative to the floating support of the invention, itself secured to said riser.

Advantageously, the floating support has a central cavity with a plurality of compartments at the ends of which said risers are in their production positions, said compartments communicating with a central channel, at the end of which there is situated a drilling derrick, said compartments extending transversely relative to said central channel.

Advantageously, said compartments and said central channel comprise a junction floor between said riser and said floating support on each of the rims defining a continuous channel of substantially constant width.

In a particular embodiment, said junction floor is secured to the wall of the cavity at a level that is intermediate between the deck of the floating support and water level.

The floating support preferably comprises means for transferring said risers between their production positions at the ends of the compartments, and the derrick position, said transfer means enabling one of said risers to be moved along said junction floor in cooperation with said holding and guidance apparatus that provides the junction between said riser and said floating support at said junction floor.

In a variant embodiment, said transfer means are fixed and secured to said floating support.

In particular, said transfer means comprise a set of winches and cables connecting said winches to said riser.

Advantageously, said transfer means comprise a carriage that is movable along said compartments and said channel.

Also advantageously, said junction floor is fitted with guide rails which enable said transfer means or said riser, in particular if said transfer means are fixed, to move along said compartments and said central channel.

BRIEF DESCRIPTION OF THE SEVERAL VIEWS OF THE DRAWINGS

Other characteristics and advantages of the present invention will appear on reading the following detailed description of embodiments given below with reference to the following figures, in which.

DETAILED DESCRIPTION OF THE PRESENTLY PREFERRED EMBODIMENTS

Figure 1:
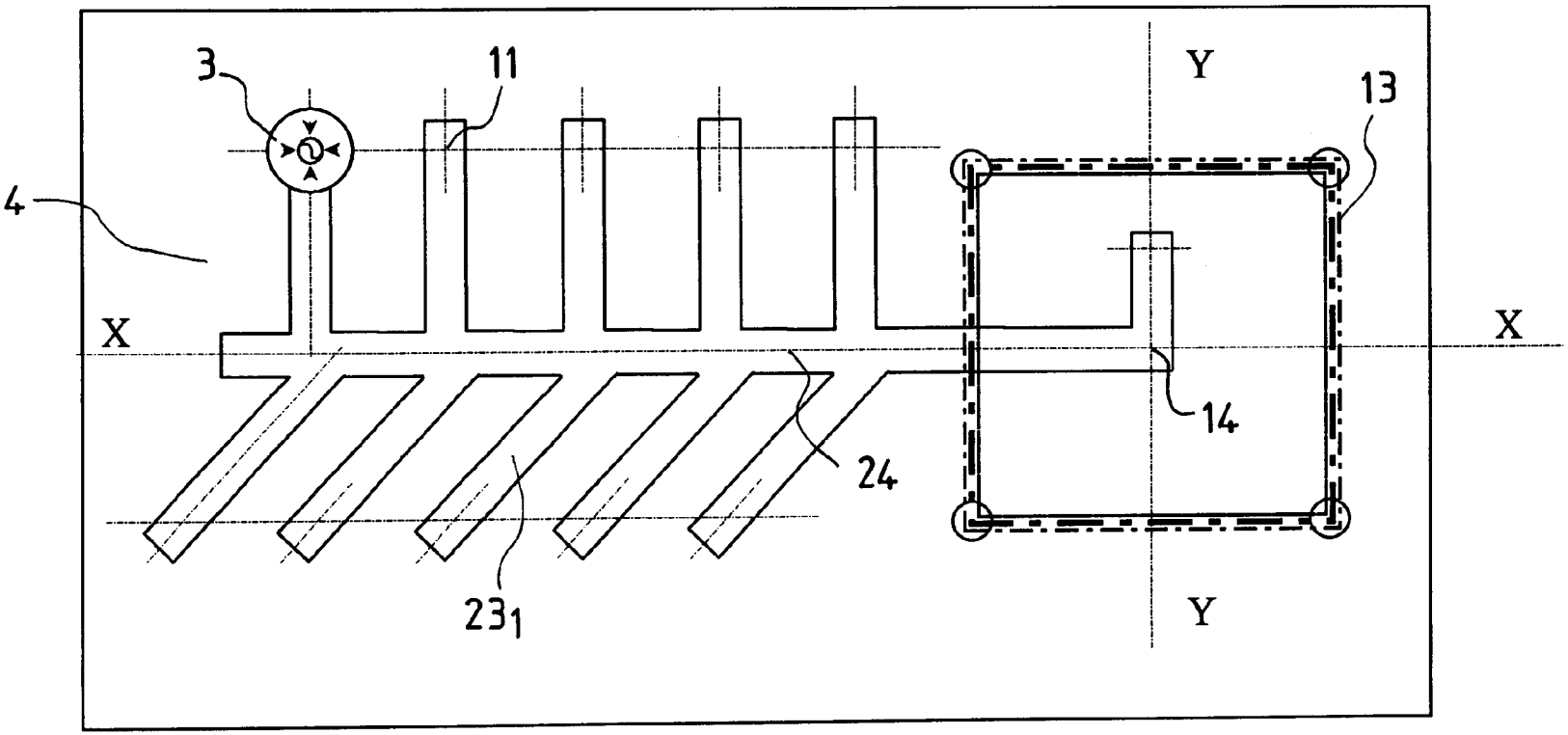
FIG. 1 is a plan view from above of the riser and the floating support with its central cavity, associated with a section view of the drilling derrick at a level that is +10 m above said junction floor.

FIG. 1 is a plan view from above of the junction floor 4. The floating support has a cavity 23 with a plurality of channel-forming compartments $\mathbf{23}_1$ and a central channel 24, said compartments $\mathbf{23}_1$ and said central channel 24 being longitudinal in shape and of substantially constant width, and presenting continuity between said positions of the risers when in production (slots) and the axis of the derrick. These compartments $\mathbf{23}_1$ are disposed transversely relative to the central channel 24 which enables one riser to be moved over the junction floor 4 between its production position 11 at the end of one of said compartments $\mathbf{23}_1$ and the position on the axis of the derrick 14 at the end of said central channel. Ten production positions 11 are shown, but only one is fitted with its riser 1 equipped with guidance apparatus 3 secured to the junction floor 4.

Figure 5:
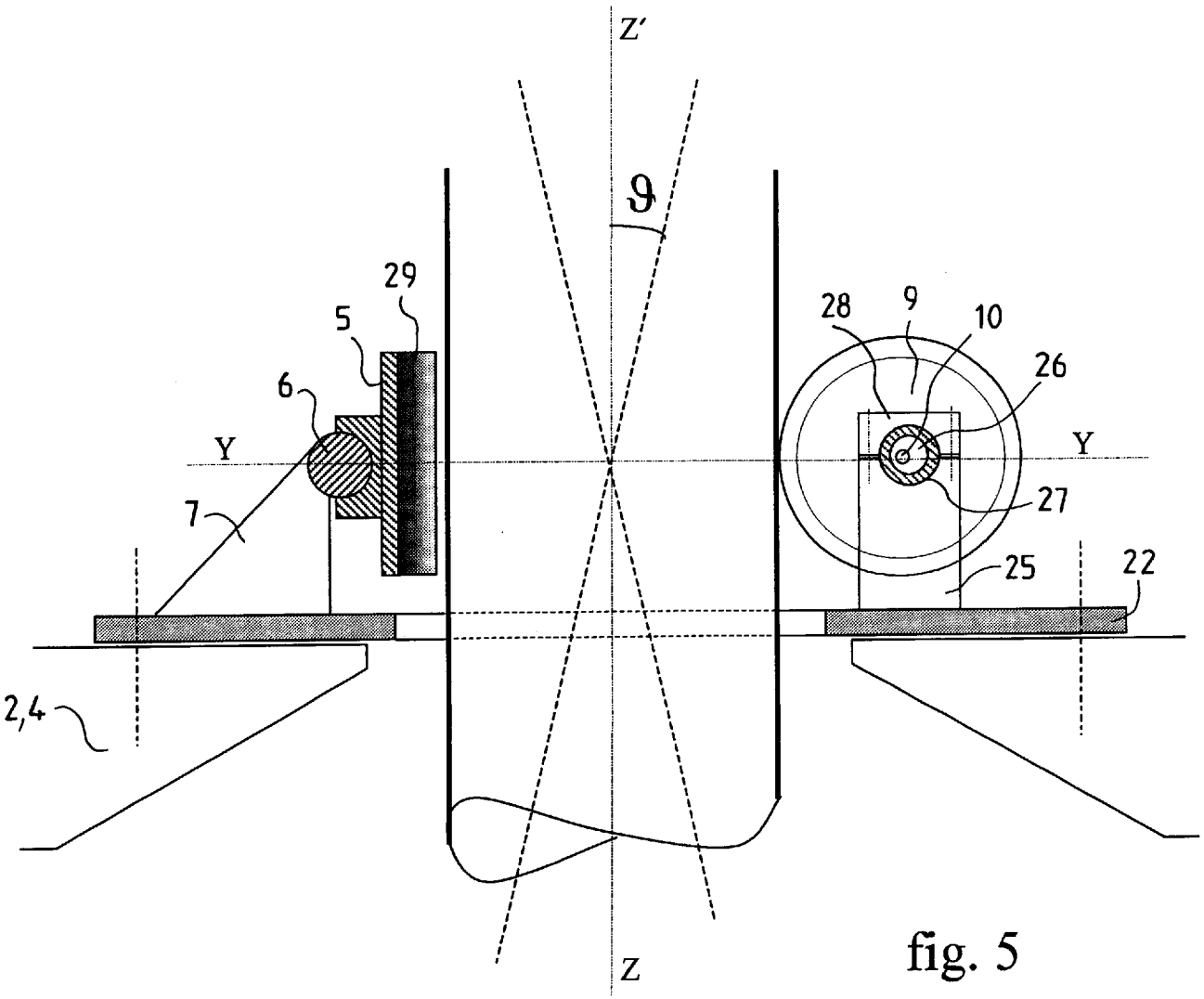
FIG. 5 is a side view of guidance apparatus of the invention having a multiplicity of wheels and pads installed in alternation around said riser, the pads and the wheels being situated in the same plane.

In FIG. 5, there is shown an embodiment of the apparatus of the invention in which the pads 5 and the wheels 9 are situated in the same plane, and the pads pivot about a joint axis 6 secured to a pad support 7 which is fixed relative to the floating support 2.

In FIG. 5, the production riser is fitted with guidance apparatus 3 of the invention enabling:

a) the riser to move parallel to its longitudinal axis ZZ';

b) the riser to move angularly about axes XX' and YY' situated in a horizontal plane and limited to a cone having a half-angle θ at the apex, where the half-angle of the cone is less than 10° in the invention; and c) very limited lateral displacements in the plane of the axes XX' and YY'.

The guidance apparatus shown in FIG. 5 is constituted by a plurality of wheels and pads installed in alternation all around said riser, the guidance apparatus having a minimum of three wheels and three pads disposed in optionally regular manner around said riser.

The wheels 9, one of which is shown in the right-hand half of FIG. 5, are secured via respective wheel supports 25 to a base 22 which is itself secured to the junction floor 4. The axis 10 of each wheel is secured to a cylindrical part 26 whose internal bore is eccentric relative to the axis of said cylindrical part. The cylinder 26 is surrounded by an elastomer layer 27 in the form of a ring, the assembly being held in position in the wheel support 25 by means of a cap 28. Each of the wheels 9 is supported by a pair of wheel supports 25 and rings 27 installed on the cylinder 26 on either side of said wheel. The device as described above: a) makes it possible by means of the eccentric assembly 10–26 to adjust the position of the wheel relative to the outside wall of the riser; and b) accommodates small displacements of the eccentric assembly when a load is applied by the riser to the wheel in the direction YY' to the right. A similar result could be obtained using a spring system.

The pads 5, one of which is shown on the left of FIG. 5, are each constituted by an anti-friction block 29 whose face facing the riser has curvature corresponding to that of said riser. The pad is supported by a joint axis 6 of the spherical ball and socket or laminated abutment type, which is secured to a pad support 7. Laminated abutments are sandwich-type composite materials built up of layers of elastomer separated by metal reinforcement and accommodated angular and longitudinal displacements that can be large and of magnitude that can be adjusted by varying the thickness of the elastomer, the number of layers, and the disposition of the metal reinforcements. Such devices are manufactured in particular by Techlam France.

While the riser is in its rest position and no force is being applied by said riser on the guide system, the positions of the wheels are adjusted by means of the above-described eccentric assemblies, so as to ensure that the blocks 29 of the pads 5 are not in contact with the riser. Thus, when forces are small, the riser is guided solely by the wheels, however when the force is increased, the elastomer ring 27 compresses allowing the wheel to back away; the riser then comes into contact with the pads adjacent to said wheel, said pads then transferring forces directly to the base 22-1 via the pad 25 without unacceptably overloading the wheel.

By operating in this way, small loads, which apply for 90% to 98% of the time, are transferred in full via the wheels, so friction and wear are very low, whereas high loads, which remain exceptional, are transferred by the pads, without running the risk of damaging the wheels or the surface of the riser.

The offset of the pads from the riser is small, e.g. of centimeter order, and the thickness of the elastomer ring 27 is designed so as to allow the axis of the wheel to move through a corresponding distance. This thickness can be 3 centimeters, for example.

By way of example, the forces encountered during the lifetime of a riser in the production position are of the order of 2 tonnes to 5 tonnes for 95% of the time, 10 tonnes to 20 tonnes over the remaining 5%, and with very exceptional load peaks corresponding to hundred-year conditions that can reach or even exceed 50 tonnes.

By implementing the invention, the size and thus the cost of the wheels is optimized, and the lifetime thereof can be long without there being any need to overdimension them for extreme situations. The pads are dimensioned for extreme circumstances and they can be maintained without difficulty during periods of calm in which they are not active.

A similar result is obtained by replacing the wheels with second pads that provide very low friction at low loading. Said second pads are then mounted instead of and replacing the wheels and they retract in the same manner when the load applied by the riser exceeds a previously determined value.

Figure 6:
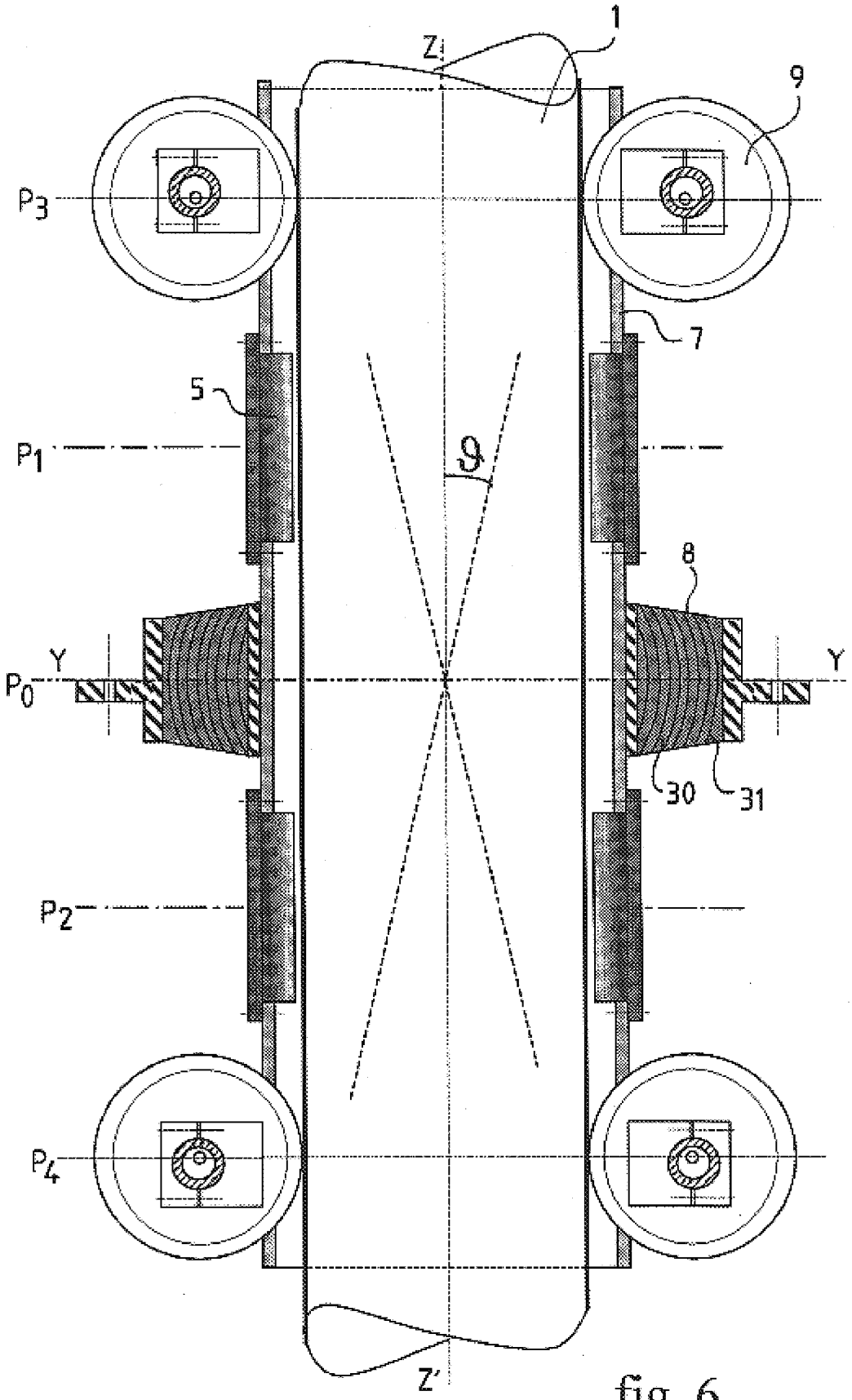
FIG. 6 shows a variant apparatus of the invention with the production riser in side view and the apparatus in section, the guidance apparatus has a ball and socket joint of the laminated abutment type and presents a combination of wheels and pads installed on a tubular element that is substantially coaxial around the axis of said riser, the pads and the wheels being situated at different levels along the longitudinal axis

FIG. 6 shows apparatus of the invention in which the pads 5 and the wheels 9 are situated on different levels along the supports axis ZZ' of the riser, and the pads are fixed relative to a tubular element 7, itself capable of pivoting relative to the floating support.

FIG. 6 is a variant of FIG. 5 and is a side view of a production riser 1 fitted with guidance apparatus 3 comprising a pad support constituted by a coaxial tube 7 on the supports axis ZZ' of the riser and fitted symmetrically about the plane XX'/YY' with a plurality of wheels 9 fitted with their eccentric assemblies 10–26 an the layer of elastomer 27 in the form of a ring in contact with said riser. The friction pads 5 are installed in a different plane, advantageously close to the plane XX'/YY' and they are not in contact with said riser. The guide assembly is symmetrical about the plane XX'/YY' and is secured to the junction floor 4 by a laminated abutment type joint 8 comprising layers of elastomer 30 and metal reinforcements 31 constituted by sheet metal shaped to form portions of spheres of center O corresponding to the apex of the cone defining pivoting limits. The laminated joint 8 allows the guidance apparatus 3 to pivot about the axes XX' and YY' and keep the set of wheels in contact with the riser 1. When forces become large, the wheels 9 retract and the pads then come into direct contact with the wall of the riser. Forces are then transmitted between the riser and the junction floor in a manner that is substantially symmetrical about the plane XX'/YY' whatever the value of the angle θ formed by the axis of the riser relative to the vertical, as shown in FIG. 5.

Figure 7:
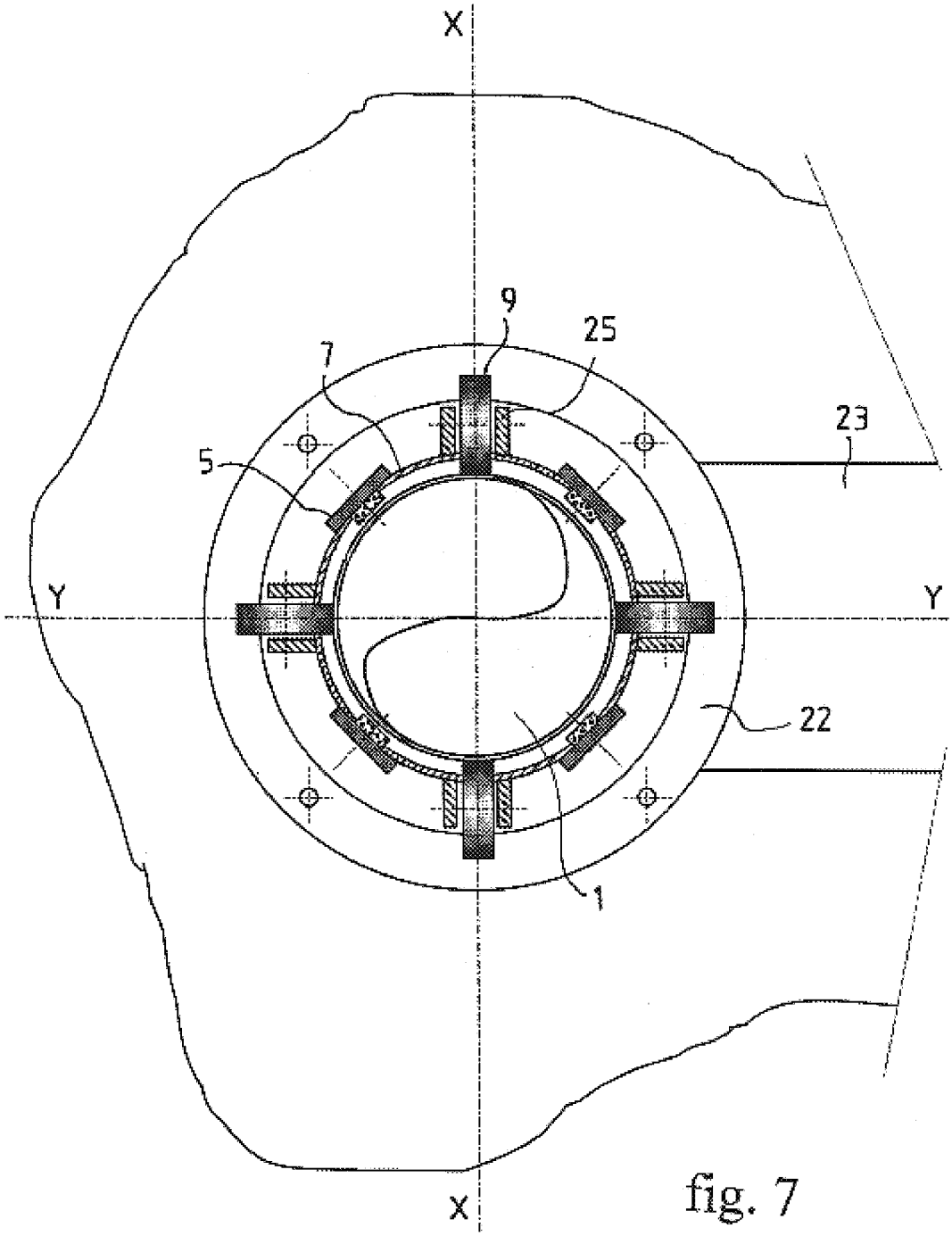
FIG. 7 is a view from above of the apparatus of the invention resting on the junction floor in which there can be seen the channel enabling the assembly to be moved towards the axis of the derrick.

FIG. 7 is a view from above of guidance apparatus similar to that shown in FIG. 6 and showing the guidance apparatus 3 of the riser 1 in the position corresponding to the slot 11 and resting on the junction floor 4. Said junction floor 4 defines a channel $\mathbf{23}_1$ enabling the riser and guidance apparatus assembly to be moved towards the derrick axis 14. The guidance apparatus is constituted:

- by four wheels 9 in contact with the riser;
- the support tube 7 via an eccentric assembly 10–26 (not shown); and
- four pads 5 set back a little from the riser.

To make the drawing understandable, the pads 5 are shown as being between pairs of wheels 9, whereas in FIG. 6 they are shown as being in vertical alignment with said wheels. The tube 7 is connected to the support 22 via the laminated abutment joint 8 of FIG. 6.

Figure 8:
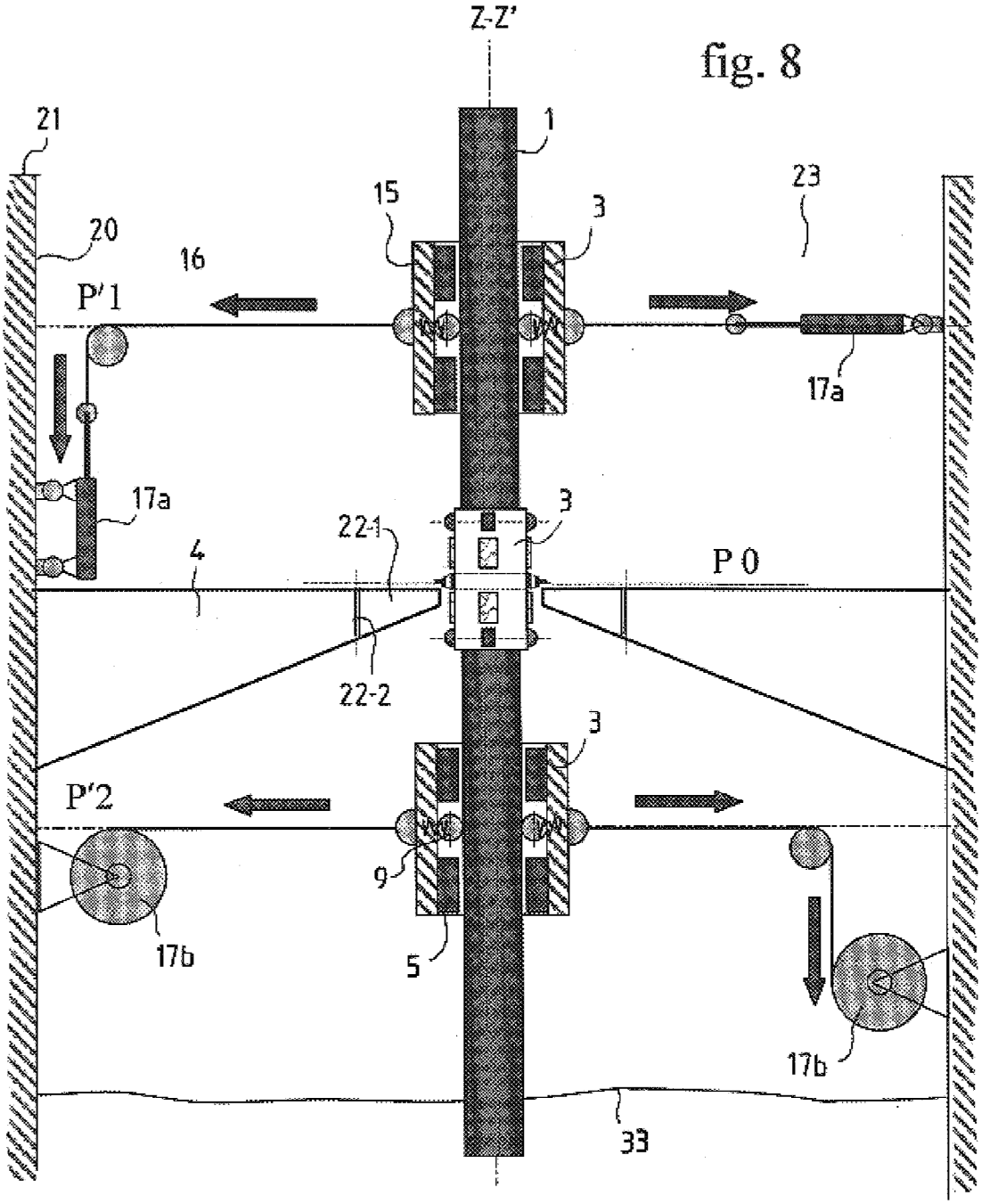
FIG. 8 is a side view of guidance apparatus of the invention associated with a riser in the operating position on the axis of the derrick and mounted to the wall of the cavity or wellbay.
Figure 11:
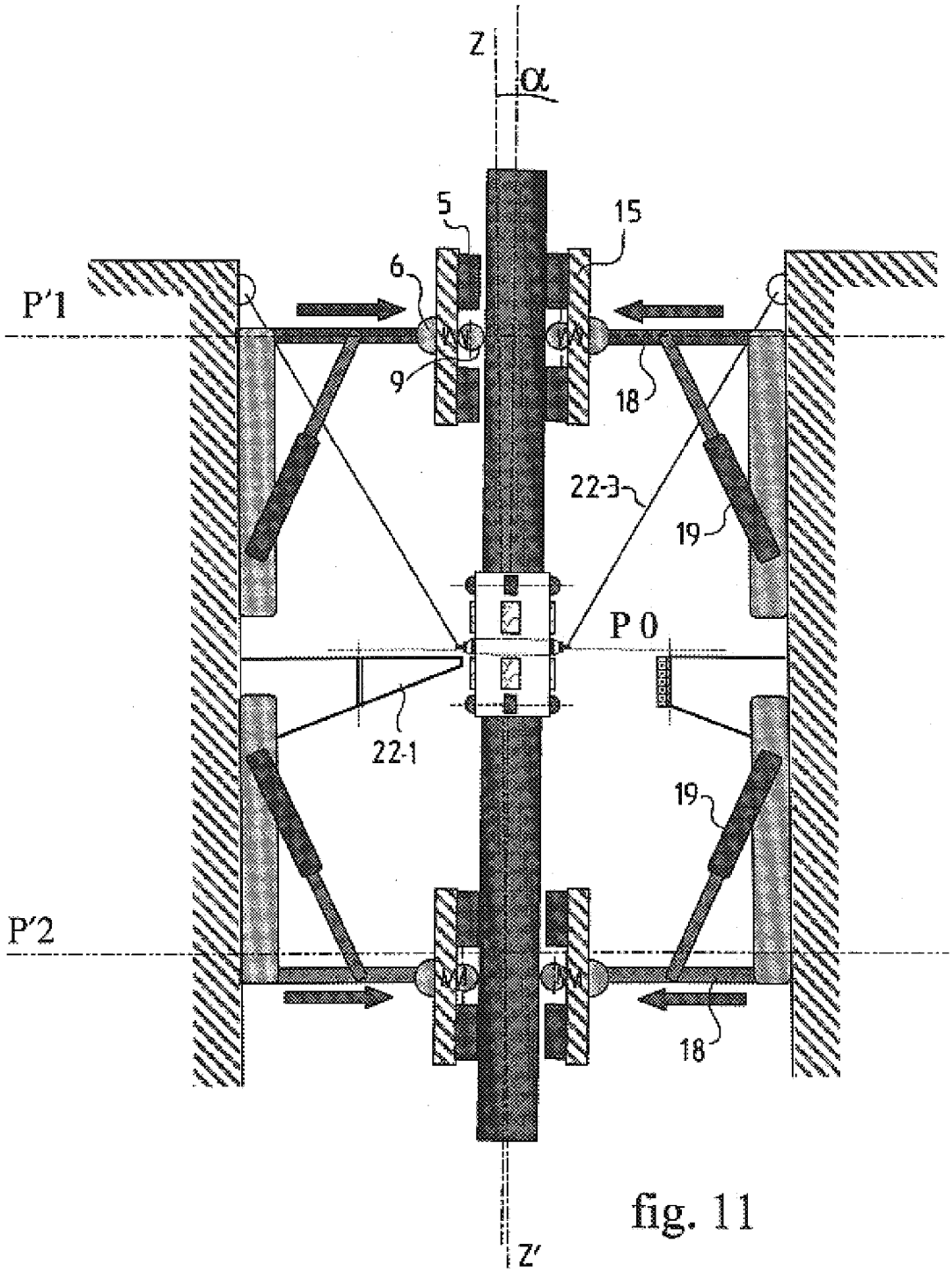
FIGS. 11 and 12 are side views of a riser in its operating position on the axis of the derrick, apparatuses of the invention being mounted on articulated arm systems provided with hydraulic actuators.
Figure 12:
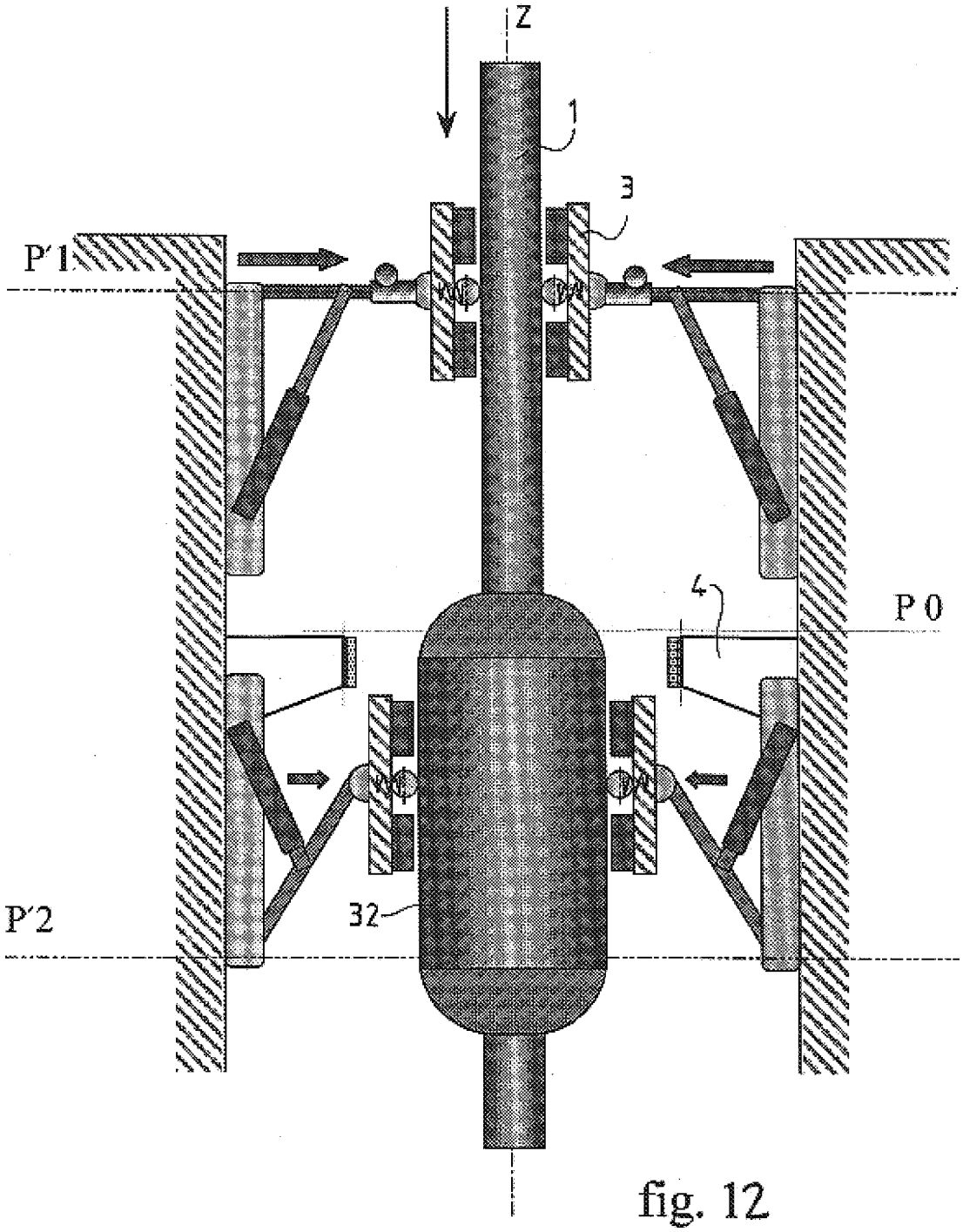

In FIGS. 8, 11, and 12 which show a riser in its operating position on the axis of the derrick, and in the associated sections showing the guidance apparatuses of the invention and situated in the planes $P'_1$ and $P'_2$, the derrick is situated above the deck 21 of the floating support and is secured thereto. The various guidance elements and the junction floor 4 are secured to the wall 20 of the cavity or wellbay.

The guidance apparatus 3 comprising the joint means of the invention for the riser 1 in a position $P_0$ corresponding to the junction floor 4 and serving to provide transfer between the slot 11 and the axis 14 of the derrick 13 are capable:

a) either of remaining in position throughout the duration of operations on the axis of the derrick, in which case the wheels move continuously during displacements of the riser along axis ZZ', but no lateral forces on the perpendicular axes XX' and YY' are transmitted by the guidance apparatus to the structure of the barge since these forces are transmitted in full to said structure between the planes $P'_1$ and $P'_2$: the guidance apparatus 3 can then be considered as inactive since it does not contribute to lateral stabilization;

b) or else being dismounted throughout the duration of operations on the axis of the derrick, and then put back into place for the return transfer to the production slot position 11.

In FIG. 8, the guidance apparatus of the invention is associated with two guide collars fitted with pads and wheels. In the plane $P'_1$, the collar is held by a hydraulic actuator system secured to the wall of the cavity or wellbay and connected to said collar, either directly or via cables under tension. The left actuator is connected via a pulley which is itself secured to the wall of the wellbay. In the plane $P'_2$, the collar is held in place by a system of winches secured to the wall of the cavity or wellbay and connected to said collar via cables under tension. The left winch is connected directly to said collar, the right winch is connected via a pulley which is itself secured to the wall of the cavity or wellbay. The guidance apparatus shown in FIG. 6 is present at the level of the plane $P_0$.

More precisely, in FIG. 8, the guidance apparatus 3 comprising joint means rests on arms $\mathbf{22}_1$ secured to the junction floor via vertical hinges $\mathbf{22}_2$ enabling said arms $\mathbf{22}_1$ to be folded back as also shown in FIGS. 11 and 12 so as to open up a passage, e.g. for passing a float.

In FIG. 8, the collar 15 is held in position by at least three cables 16 in tension, two of which are dimensioned as explained below when describing FIGS. 9 and 10. The cables 16 are connected to the collars 15 via attachment lugs and:

a) in plane $P'_1$, on the left of the drawing, to a hydraulic actuator 17*a* secured to the wall 20 of the cavity or wellbay, the cable passing around a deflector pulley, itself secured to said wall 20; on the right of the drawing to a hydraulic actuator 17*a* secured to the wall 20 of the cavity or wellbay; and b) in the plane $P'_2$ on the left of the drawing, to a winch 17*b* secured to the wall 20 of the cavity or wellbay; on the right of the drawing, to a winch 17*b* secured to the wall 20 of the cavity or wellbay, the cable being passed around a deflector pulley, itself secured to said wall 20.

Figure 9:
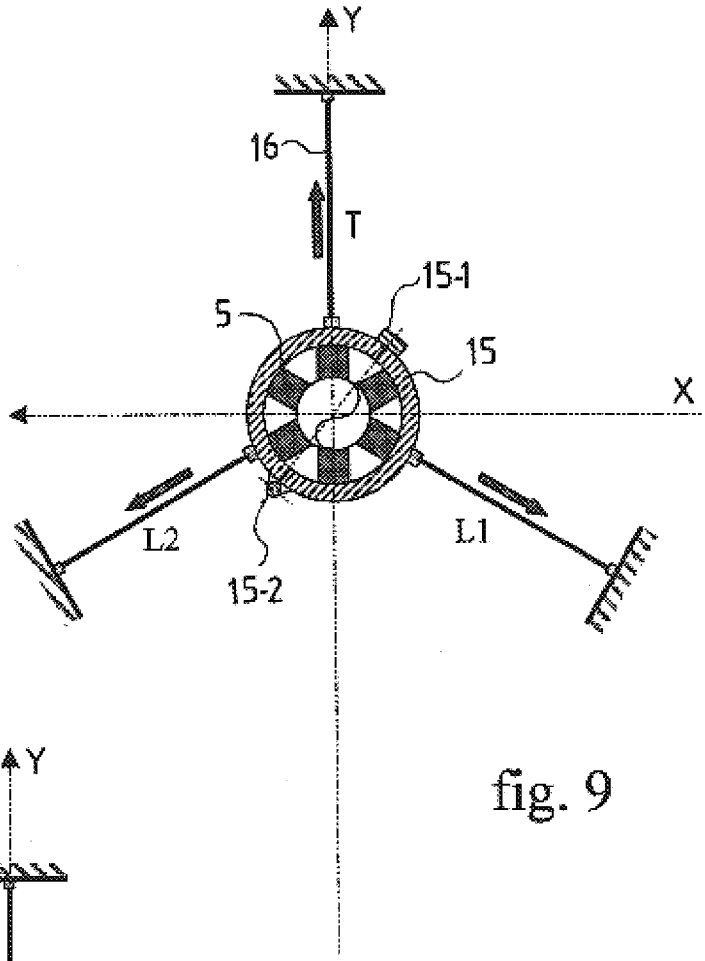
FIGS. 9 and 10 are views from above showing details of a collar which serves as a support for joint means shown in the plane of the pads, which collar is maintained under tension by three or four cables connected to a tensioning system.
Figure 10:
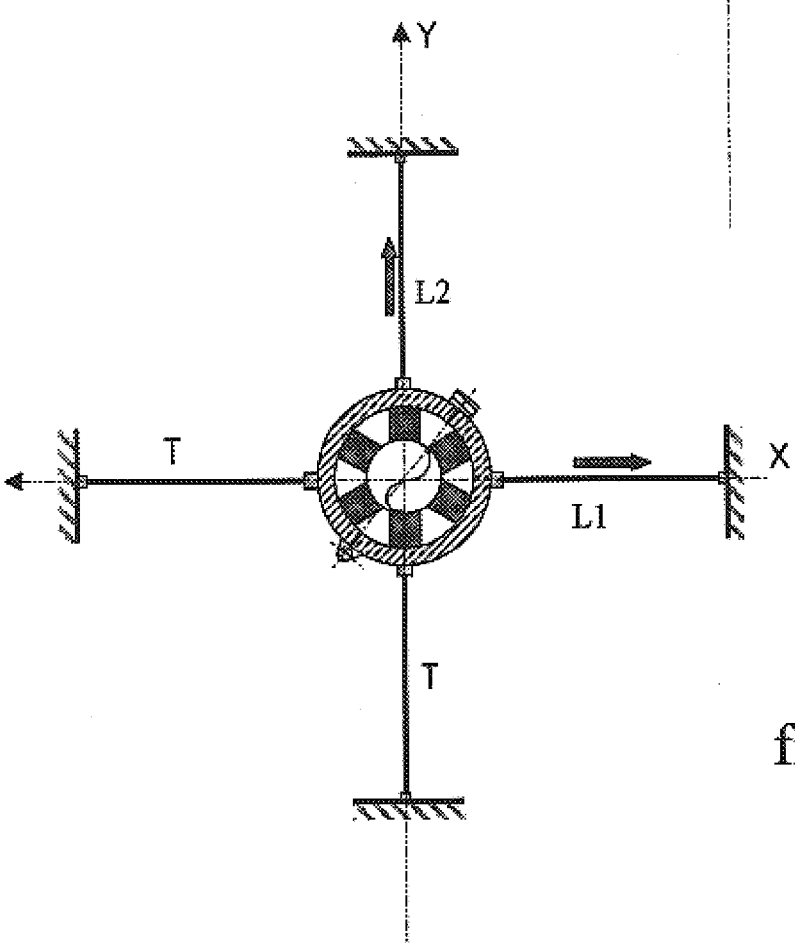

In FIGS. 9 and 10, the collar 15 is held in tension by three or four cables 16 connected to a tensioning system (not shown), characterized in that only two cables 16 of lengths $L_1$ and $L_2$ are adjusted in such a manner that the axis of the collar on axis ZZ' coincides substantially with the axis of the derrick. The other cables are then merely kept under tension at a level of tension greater than the greatest anticipated level of tension, e.g. corresponding to hundred-year conditions (100 tonnes). The collar 15 is made up of two half-shells interconnected on one side by a hinge $\mathbf{15}_1$ and on the other side by a locking system $\mathbf{15}_2$ enabling the assembly to be put into place around the riser and to be removed once operations have been completed.

FIG. 10 shows a four-strand version of FIG. 9, in which two of the strands are adjusted to lengths corresponding to $L_1$ and $L_2$, while the others are merely kept under tension. The apparatus of the invention makes it possible to ensure that the axis of the riser coincides with the axis of the derrick by modifying the respective lengths $L_1$ and $L_2$ of the dimension-defining cables in the plane $P'_1$ and/or in the plane $P'_2$. The apparatus of the invention also makes it possible to keep the axis of the riser parallel to an arbitrary given direction, that is substantially fixed relative to the axis of the derrick.

In FIGS. 11 and 12, the riser in position on the axis of the derrick is stabilized in the planes $P'_1$ and $P'_2$ by a system of articulated arms 18 driven by hydraulic actuators 19 supporting in plane $P'_1$ guidance by means of wheels associated with friction pads, and in plane $P'_2$ guidance by means of a collar 15 similar to the collar shown in FIGS. 8 and 9. The forces on the riser in the plane $P'_1$ are directed to the right and cause the wheel which is mounted on a spring system to retract until the pads come into contact with said riser and transmit forces directly thereto corresponding to extreme conditions (hundred-year conditions) without damaging guidance provided by the wheels, and without damaging the wall of the riser. In this position the axis of the riser is offset angularly very slightly from the axis of the derrick, with this angular offset being represented by the angle $\alpha$ which remains less than 5°, and preferably less than 2°.

In FIG. 11, the support beam $\mathbf{22}_1$ is in a folded-back position so the guidance apparatus 3 is held in a position close to $P_0$ by means of two cables $\mathbf{22}_3$ connected to the wall 20 of the wellbay.

In FIG. 12, bottom guidance is shown in the open position so as to pass a float on a production riser that is being assembled, as the various component elements thereof are being lowered. The guidance remains in contact with the walls of the float so as to limit movement of the entire suspended pipe assembly.

FIG. 12 is a side view of a riser 1 being installed on the axis of the derrick. The guide system in the plane $P'_2$ is identical to that in the plane $P'_1$ The planes $P'_1$ and $P'_2$ are spaced apart by eight to ten meters.

The riser is being assembled and the assembly is being lowered together with a float 32. Bottom guidance is shown in its open position so as to allow said float to pass through, while nevertheless keeping contact with the walls of said float so as to put a limit on the movements of the entire suspended pipe assembly.

During this stage of operation, the guidance apparatus associated with the plane $P_0$ has not yet been installed around the riser 1, but it will be installed as soon as the riser is ready to be transferred to its production slot.

In FIG. 12, the articulated arms in the plane $P'_1$ are provided with respective mechanical or hydraulic devices 34 enabling the length of each of the arms to be adjusted independently, which makes it possible by coordinated variation of the length of each of the arms to offset the top of the cone as defined in FIGS. 5 and 6 by a known amount in a known direction in the plane $P'_1$. Advantageously by fitting both planes $P'_1$ and $P'_2$ with articulated arms of adjustable length, it is possible to maintain the axis of the riser parallel to an arbitrary direction that is substantially fixed relative to the axis of the derrick.

Figure 2:
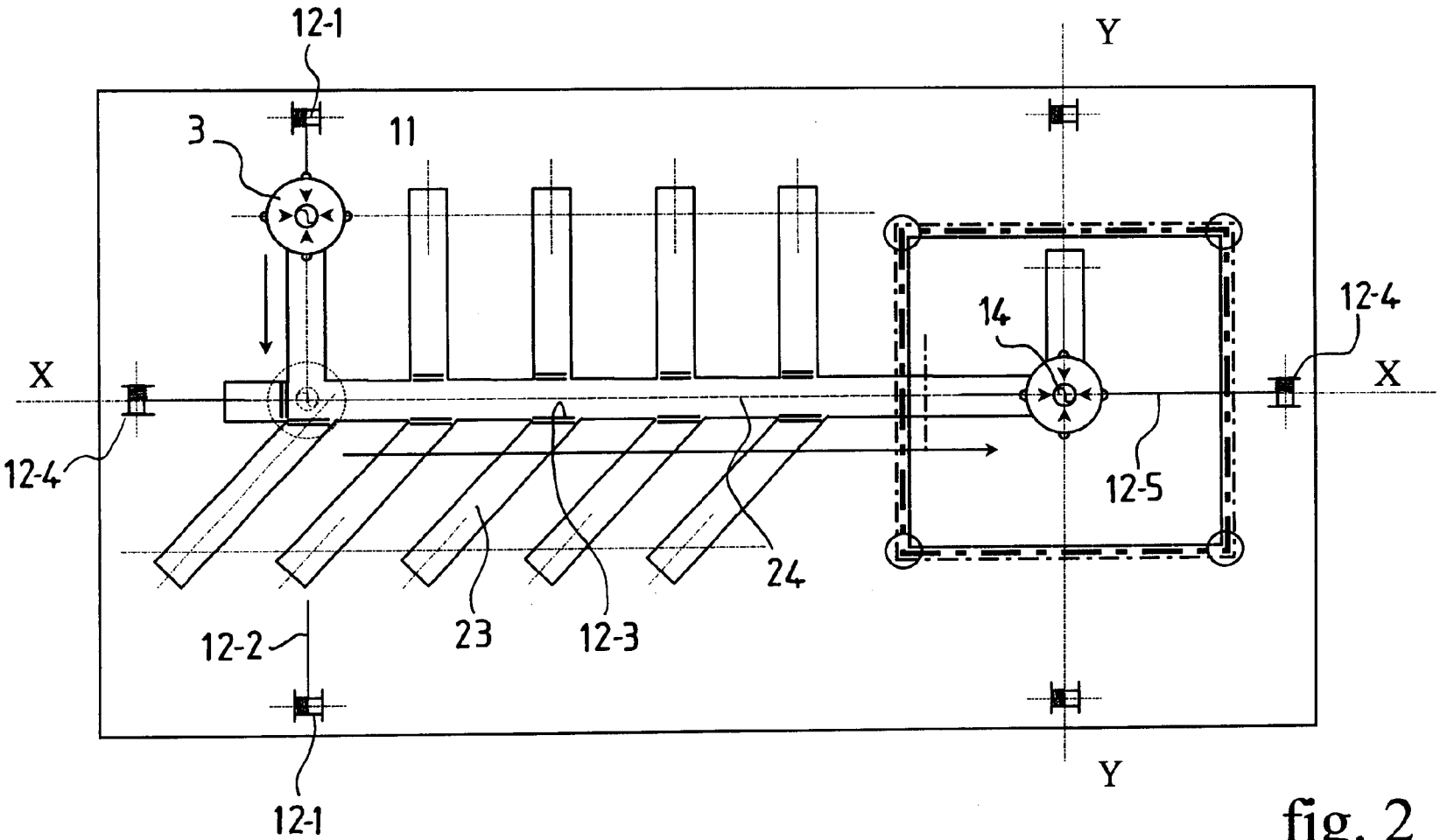
FIG. 2 is a plan view like FIG. 1, further showing means for transferring the apparatus of the invention for holding and guiding a riser from the production position to the axis of the drilling derrick.
Figure 4:
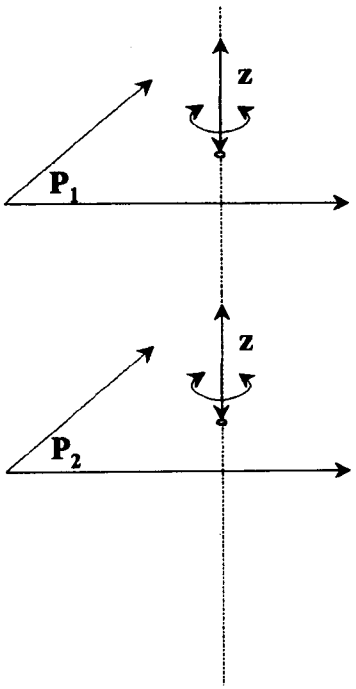
FIG. 4 is a diagram showing the degrees of freedom in rotation and translation allowed by the guidance apparatus of the invention when the riser is in position on the axis of the derrick; in this configuration, the riser is guided at at least two distinct levels, the level of a plane $P'_1$ and the level of a plane $P'_2$, said planes being suitably spaced apart.
Figure 3:
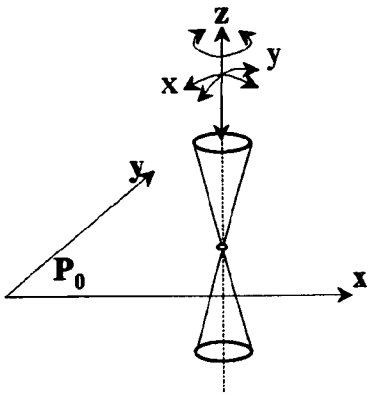
FIG. 3 is a diagram showing the degrees of freedom in rotation allowed by the guidance apparatus of the invention, and corresponding to possible movement of the riser in its production position in its slot and throughout transfer to the axis of the derrick.

The holding and guidance apparatus 3 of the invention having joint means can be transferred to the axis of the derrick by means of transfer means that are fixed relative to the floating support and that are constituted by winches $\mathbf{12}_1$ and $\mathbf{12}_4$ and cables $\mathbf{12}_2$ as shown in FIG. 2.

In FIG. 2, the junction floor 4 has means for transferring the riser and guidance apparatus of the invention, which means are constituted by winches $\mathbf{12}_1$ connected by cables $\mathbf{12}_2$ to the guidance apparatus 3 which moves merely by sliding on the junction floor 4 while being guided in the compartments $\mathbf{23}_1$ by rails $\mathbf{12}_3$. These two winches enable the assembly comprising the riser and the guidance apparatus 3 to be moved between the slot position 11 and the axis of the central channel 24. The rails $\mathbf{12}_3$ facilitate passing the apparatus 3 over adjacent compartments starting from the production position and going to the axis 14 of the derrick. Once the riser and its guidance apparatus are in position in the central channel 34, the winches $\mathbf{12}_4$ are connected to the support 22 of the guidance apparatus 3 by two cables $\mathbf{12}_5$, and the cables $\mathbf{12}_2$ and the winches $\mathbf{12}_1$ are disconnected. By acting on the winches $\mathbf{12}_4$, the assembly comprising the riser and the guidance apparatus 3 is then transferred from the central position 24 to the axis 14 of the derrick.

Figure 13:
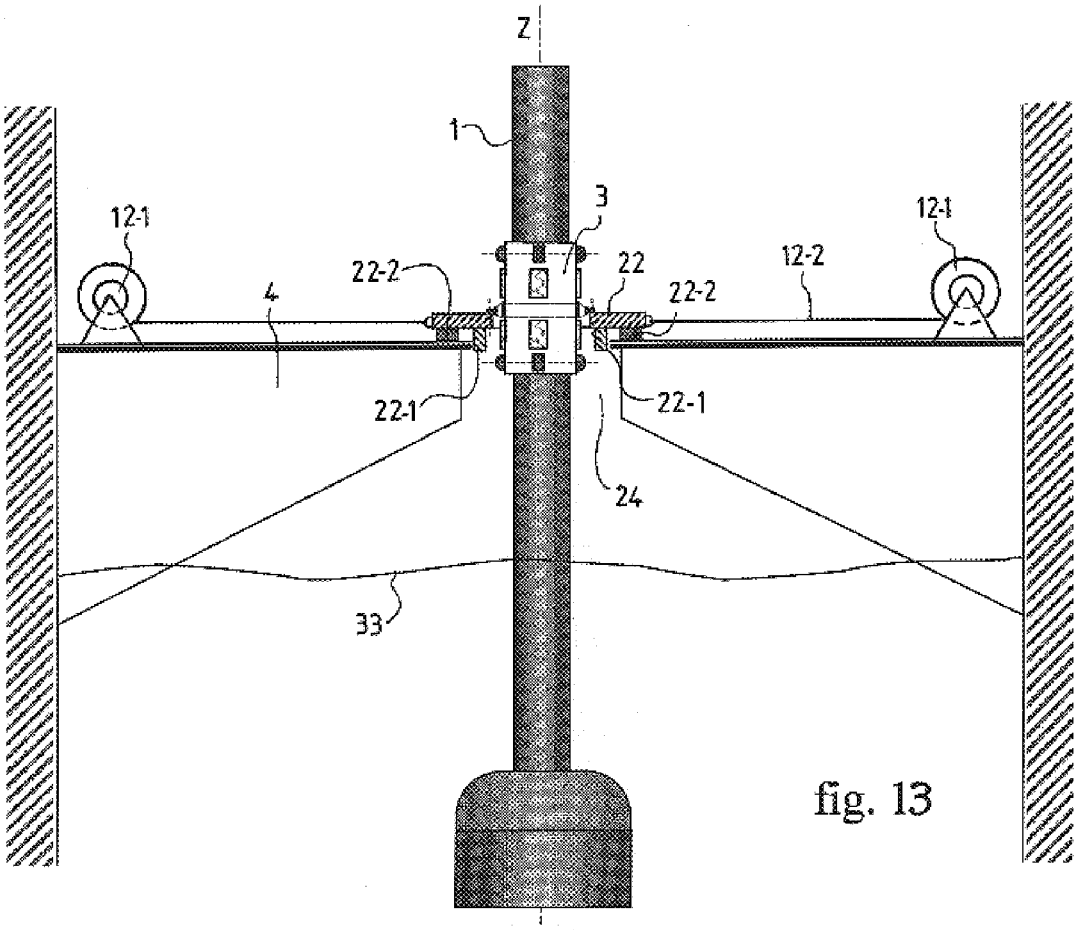
FIG. 13 is a side view of the riser provided with holding and guidance apparatus having joint means 3 of the invention connected to transfer means 12 in the process of being transferred along the central channel 24 of the cavity in the floating support.

The riser can be displaced by sliding the support 22 of the guidance apparatus 3 which is in the form of a washer as shown in FIG. 13. In FIG. 13, tubular elements $\mathbf{22}_1$ secured to the support 22 and located beneath the support 22 enable the riser to be guided in the central channel 24 between the rails $\mathbf{12}_3$. Friction pads $\mathbf{22}_2$ placed beneath the support 22 and secured thereto enable the support 22 to be caused to slide on the junction floor 8 under drive from the winches $\mathbf{12}_4$ and the cables 125 (not shown) once hey are put into action.

While remaining within the spirit of the invention, said guidance apparatus could equally well have been left in place. Under such circumstances, the apparatus must be capable of opening so as to release the riser which is then taken over by a second guidance apparatus for performing the same function, but with the difference that since the transfer operation is of short duration and is preferably performed in calm weather, said guidance apparatus can be considerably simplified.

Transfer from the slot position to the axis of the derrick is described above as being performed by winch type means guided in the compartments $\mathbf{23}_1$ of the junction floor 4. A similar result can be obtained by a carriage traveling on rails using means such as wheels actuated either manually or by an engine or by an electric motor associated with batteries, or indeed by stepper drive systems based on the use of hydraulic actuators. Such a carriage is advantageously fitted with an arm having an opening clamp at the end of which a guidance apparatus as shown in FIG. 5, or in a simplified version, enables the riser to be taken hold of in its slot position when the permanent guidance apparatus is opened to allow transfer to the axis of the drilling derrick where guidance apparatuses such as those shown in FIGS. 8 to 13 are implemented.

What is claimed is:

1. Apparatus for holding and guiding a riser relative to a floating support, the apparatus including guide means enabling said riser to slide along its longitudinal axis ZZ' and guiding lateral displacements thereof in a horizontal plane XX', YY' perpendicular to said longitudinal axis of the riser, the apparatus being characterized in that it comprises joint means secured to said floating support and enabling:

a) said riser to rotate about a horizontal axis XX', YY' perpendicular to the longitudinal axis ZZ' of said riser within the limit of a cone having a half-angle at the apex that is less than or equal to 10°, said horizontal axis and said apex of the cone being situated substantially at the center of the riser and level with the midplane of the zone along the longitudinal axis ZZ' where said joint means are situated; and b) said riser to slide along the longitudinal axis ZZ' and to be guided in its lateral displacements in a plane XX', YY' substantially perpendicular to said longitudinal axis of the riser, and said joint means comprise:

first friction pads mounted on a pad support enabling said pads to pivot about respective axes perpendicular to said longitudinal axis of said riser ZZ'; and said first pads co-operating with one of wheels and second friction pads, such that said one of said wheels and said second pads bear against said riser, and enable it to slide, and said riser comes to bear against said first pads only when said wheels and said second pads are moved under the effect of lateral displacements of said riser.

2. Apparatus according to claim 1, characterized in that said first pads can pivot relative to respective axes secured to said pad support.

3. Apparatus according to claim 1, characterized in that said first pads are fixed relative to said pad support and said pad support can pivot relative to said floating support to enable said pads to pivot about an axis XX' perpendicular to said longitudinal axis ZZ' of said riser.

4. Apparatus according to claim 3, characterized in that said first pads are fixed on a tubular element encasing said riser coaxially, said tubular element being mounted on a ball and socket joint enabling said pivoting and said rotation respectively of said first pads and of said riser.

5. Apparatus according to claim 4, characterized in that said joint is a laminated abutment within which said tubular element is embedded.

6. Apparatus according to claim 1, characterized in that said one of said second pads and said wheels are mounted on axes extending perpendicularly to the vertical axis ZZ' of said riser, the axes of said wheels being capable of moving in translation on axes XX', YY' perpendicular to the longitudinal axis ZZ' of said riser.

7. Apparatus according to claim 1, characterized in that said first pads are distributed symmetrically around said riser and comprise at least three pads.

8. Apparatus according to claim 7, wherein said at least three pads are situated at the same level along the longitudinal axis ZZ' of said riser.

9. Apparatus according to claim 1, characterized in that said one of said second pads and said wheels are disposed symmetrically around said riser about its longitudinal axis ZZ'.

10. Apparatus according to claim 9, wherein said axes of rotation are situated substantially in the same plane.

11. Apparatus according to claim 1, characterized in that said first pads are mounted on respective axes situated substantially in the same horizontal plane as the axes of said wheels, and said first pads and said wheels are disposed successively and symmetrically around said riser in alternating manner.

12. Apparatus according to claim 1, characterized in that said first pads and said wheels are disposed in a staggered configuration, their respective pivot and rotation axes being situated at different respective levels along the longitudinal axis ZZ' of said riser.

13. Apparatus according to claim 1, characterized in that said first pads are disposed on at least two different levels $P'_1$ and $P'_2$ along said longitudinal axis ZZ' of said riser, and said levels $P'_1$ and $P'_2$ are disposed symmetrically about a horizontal plane corresponding substantially to the midplane $P_0$ of the zone along the longitudinal axis ZZ' where said joint means are situated.

14. Apparatus according to claim 1, characterized in that the axes of rotation of the wheels are disposed on at least two different planes $P_3$, $P_4$ perpendicular to said longitudinal axis ZZ' of said riser, and said planes $P_3$, $P_4$ are disposed symmetrically about a horizontal plane $P_0$ corresponding substantially to said midplane of the zone along the longitudinal axis of said riser where said joint means are situated.

15. Apparatus according to claim 1, characterized in that said first pads are situated on two different levels along the longitudinal axis ZZ' of said riser, an upper level and a lower level, and said one of said second pad, and said wheels are situated above said upper level and below said lower level.

16. Apparatus according to claim 1, characterized in that said first pads are situated on two of said different levels, an upper level and a lower level, and said wheels are situated between said levels $P_1$ and $P_2$.

17. Apparatus according to claim 1, characterized in that the apparatus is installed on the floating support to hold and guide one of said risers in its production.

18. Apparatus according to claim 17, characterized in that said joint means are mounted on the junction floor between said riser and said floating support, situated at the level $P_0$ of the wall of the cavity of said floating support between the level of the deck of the floating support and the water level.

19. Apparatus according to claim 1, characterized in that the apparatus is connected to transfer means for transferring one of said risers from its production position to the axis of a drilling derrick.

20. Apparatus according to claim 1, characterized in that the apparatus is installed on said floating support to hold and guide one of said risers in an operating position in a derrick installed on said floating support.

21. Apparatus according to claim 20, characterized in that it comprises:

said joint means comprising pads cooperating with wheels situated on a first level $P'_1$ and a second level $P'_2$ along the wall of the cavity of the floating support, respectively above and below the level $P_0$ of said junction floor between the riser and said floating support; and the upper and lower levels are far enough apart to hold said riser substantially on the axis of said derrick, and to allow essentially vertical movements along said vertical axis ZZ' of said riser and the derrick, the angular displacements of said riser relative to the axis of said derrick being less than 5°.

22. Apparatus according to claim 21, characterized in that said joint means are fixed inside a collar held in place around the riser by cables connected by a tensioning system to the wall of the cavity of said floating support, at least one of said levels $P'_1$ and $P'_2$.

23. Apparatus according to claim 22, characterized in that the collar is positioned around the riser by adjusting the lengths of two of said cables, the other cables being kept under tension.

24. Apparatus according to claim 21, characterized in that the apparatus comprises, at each of said levels $P'_1$ and $P'_2$, a system of articulated arms including hydraulic actuators with said joint means being mounted at the ends of said arms; each of said articulated arms being capable of being adjusted in length so as to create an offset between the axis of the riser and the axis of the derrick.

25. Apparatus according to claim 21, characterized in that the articulated arm system can move between a closed position and an open position, such that:

in the closed position, said wheels of said joint means contacting said riser; and in the open position, a float fitted to said floating riser passes through, said joint means wheels remaining in contact with said float.

26. A method of holding and guiding a floating riser relative to a floating support enabling said riser to slide along its longitudinal axis and guiding lateral displacements thereof in a horizontal plane perpendicular to said riser, by means of apparatus according to claim 1.

27. A transfer method according to claim 26, characterized in that said transfer means are fixed and secured to said floating support.

28. A transfer method according to claim 27, characterized in that said transfer means comprise a set of winches and of cables connecting said winches to said riser.

29. A method of transferring a riser on a floating support of the type having a central cavity from a production position of the riser to a position within a drilling derrick by using an apparatus which includes guide means enabling said riser to slide along its longitudinal axis ZZ' and guiding lateral displacements thereof in a horizontal plane XX', YY' perpendicular to said longitudinal axis of the riser, the apparatus comprising joint means secured to said floating support which enables said riser to (a) rotate about a horizontal axis XX', YY' perpendicular to the longitudinal axis ZZ' of said riser within the limit of a cone having a half-angle at the apex that is less than or equal to 10°, said horizontal axis and said apex of the cone being situated substantially at the center of the riser and level with the midplane of the zone along the longitudinal axis ZZ' where said joint means are situated, and (b) slide along the longitudinal axis ZZ' and to be guided in its lateral displacements in a plane XX', YY' substantially perpendicular to said longitudinal axis of the riser, the joint means comprising first friction pads mounted on a pad support enabling said pads to pivot about respective axes perpendicular to said longitudinal axis of said riser ZZ', the first friction pads cooperating with one of wheels and second friction pads such that said one of said wheels and said second friction pads bear against said riser, and enable said riser to slide, said method being characterized in that said riser is displaced in said cavity of a floating support by displacing said apparatus relative to the floating support, said apparatus itself being secured to said riser.

30. A transfer method according to claim 29, characterized in that the floating support is of the type having a central cavity within which a plurality of risers can be positioned, and said central cavity has a plurality of compartments at the ends of which said risers are in their production positions, said compartments communicating with a central channel, at the end of which there is situated a drilling derrick, said compartments being disposed transversely relative to said central channel.

31. A method according to claim 29, characterized in that said compartments and said central channel comprise a junction floor between said riser and said floating support on each of the rims defining a continuous channel of substantially constant width, and the floating support has transfer means for transferring said risers between their production positions at the ends of the compartments, and the position of the derrick, said transfer means enabling one of said risers to be moved along said junction floor in co-operation with one of said riser holding and guidance apparatuses, said apparatus providing the junction between said riser and said floating support.

32. A transfer method according to claim 29, characterized in that said transfer means comprise a carriage that is movable along said compartments and along said central channel.

33. A transfer method according to claim 29, characterized in that said junction floor is fitted with guide rails enabling said transfer means or said riser to be moved along said compartments and along said central channel.

* * * * *